US005410857A

United States Patent [19]

Utley

[11] Patent Number: 5,410,857

[45] Date of Patent: May 2, 1995

[54] PROCESS FOR MAKING WINDOWED FORM, FILL AND SEAL BAGS

[75] Inventor: Wayne S. Utley, Portsmouth, Va.

[73] Assignee: Vitex Packaging, Inc., Suffolk, Va.

[21] Appl. No.: 230,512

[22] Filed: Apr. 20, 1994

[51] Int. Cl.[6] ..... B65B 61/00; B65B 43/04

[52] U.S. Cl. ..... 53/410; 493/222; 156/270; 156/277; 156/267; 53/455

[58] Field of Search ..... 53/410, 135.3, 389.3, 53/128.1, 411, 455, 449, 172, 562; 493/222, 194, 196, 279, 280, 281, 282, 283; 156/256, 267, 514, 277, 257, 261, 270, 291

[56] References Cited

U.S. PATENT DOCUMENTS

| | | | |
|---|---|---|---|
| 1,958,005 | 5/1934 | Klinger | 156/514 |
| 3,350,988 | 11/1967 | Schultz . | |
| 3,456,855 | 7/1969 | Mutter | 493/196 |
| 3,459,625 | 8/1969 | Heller, Jr. et al. | 156/514 |
| 3,468,227 | 9/1969 | Volks et al. | 493/222 |
| 3,628,304 | 12/1971 | Hornung | 493/222 |
| 3,803,332 | 4/1974 | Seiferth et al. . | |
| 4,173,922 | 11/1979 | Helm | 493/222 |
| 4,413,984 | 11/1983 | Alter . | |
| 4,552,789 | 11/1985 | Winchell . | |
| 4,619,361 | 10/1986 | Thomas, Jr. . | |
| 4,726,171 | 2/1988 | Kreager et al. | 53/449 |
| 4,905,453 | 3/1990 | Siebring | 493/194 |
| 4,995,217 | 2/1991 | Francis, Jr. | 53/449 |

*Primary Examiner*—Lowell A. Larson
*Assistant Examiner*—Rodney A. Butler
*Attorney, Agent, or Firm*—Griffin, Butler Whisenhunt & Kurtossy

[57] ABSTRACT

A process for making windowed form, fill and seal bags (70) for containing perishable and/or nonperishable goods involves linearly conveying an endless strip of paper-like material (12) through an adhesive application station (14) which applies adhesive to an adhesive side (18) of the endless strip of paper-like material throughout, with the exception of a window area (34) on each individual bag form (36*a, b, c,* etc.) making up the endless strip. The endless strip is then conveyed through a synchronized window-blanking station (44) which cuts a window blank (54) from each window area so as to form a window opening (50) therein. The adhesive side is then adhered to a transparent plastic heat-sealable film (58). Side edge margins (32) are slit from the endless strip of paper material to leave a composite endless form (10) for, in turn, making the flexible windowed, form, fill and seal bags (70) for containing perishable and/or nonperishable goods. To make these bags, the individual bag forms (36*a, b, c,* etc.) are cut from the composite endless form material and folded so that the heat-sealable film (58) is in contact with itself at overlapping edges of the bag form and these edges are then heat-sealed together.

13 Claims, 5 Drawing Sheets

PROCESS FOR MAKING WINDOWED FORM, FILL AND SEAL BAGS

BACKGROUND OF THE INVENTION

This invention relates broadly to processes for making windowed bags for containing perishable and/or nonperishable goods and, more specifically, to methods of making a composite endless form which, in turn, can be used for making windowed, form, fill and seal bags, or containers, specifically used by form, fill and seal equipment, for example, such as ALLPAC F/F/S machines and BARTELT equipment.

A form, fill and seal machine can be supplied with an endless strip of paper-like material and bulk consumer product to automatically produce individual containers of product, such as tea, for retail sale. In this regard, in one mode of operation the endless strip of paper-like material is formed as a composite of paper and extruded polyethylene laminated on one side of the paper. The form, fill and seal equipment receives this endless composite, cuts the endless composite into individual bag forms, folds the individual bag forms into container bags with the polyethylene laminates overlapping at edges thereof and with materials being enclosed in the container bags, and heat-seals the polyethylene together at these edges. Thus, filled bags are formed by the form, fill and seal equipment and delivered to an outlet of the form, fill and seal equipment.

A problem which exists for the above described process is that container bags produced in this manner normally do not have windows therein through which the products contained therein can be viewed. In this regard, in many cases it is desirable that such bags have paper on an outer surface thereof onto which sales indicia can be printed, and a plastic, such as polyethylene, on an inner surface thereof for creating edge seams and for sealing the products therein. The paper is normally opaque. Although it is possible to use a transparent paper-like material instead of paper, which can then be made opaque at desired areas, such materials and the processing thereof are expensive and do not always meet the needs of the market. If one were to "blank" a window in the prior art paper laminate prior to polyethylene being extruded thereon, the molten polyethylene would pass through the window opening and contaminate equipment or otherwise cause problems. Similarly, it is not possible to cut the window after the molten polyethylene has been applied to the paper because the polyethylene material sticks to the paper.

It is therefore an object of this invention to provide a process for making an endless form for, in turn, making windowed bags for containing perishable and/or nonperishable goods.

Similarly, it is an object of this invention to provide a process and apparatus for making such an endless form which can be used by form, fill and seal equipment for making and filling windowed containers of retail goods.

At the same time, it is an object of this invention to provide a process and apparatus for making windowed form, fill and seal bags involving the use of an endless form having sales indicia printed thereon.

SUMMARY OF THE INVENTION

According to principles of this invention, a process and apparatus for making windowed form, fill and seal bags involves the steps of linearly conveying an endless strip of paper, or paper-like material, through an adhesive station for receiving a pressure-sensitive adhesive substantially covering one side thereof, with the exception of a window area of each bag form making up the endless strip of paper. The endless strip of paper is then conveyed through a synchronized window-cutting station which cuts a window blank at each window area. The endless strip of paper is then conveyed to a combining station where its adhesive side is laminated to an endless strip of transparent heat-sealable plastic film which substantially covers the adhesive side, including the window area from which the window blank has been cut. In one embodiment the window blank is oblong an extends diagonal to a length axis of the endless strip of paper. Individual form, fill and seal bags can be formed from the composite strip of material produced by the process of this invention by separating the bag forms and heat sealing the plastic film together at edge margins with the form, fill and seal machines.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

Figure 1:
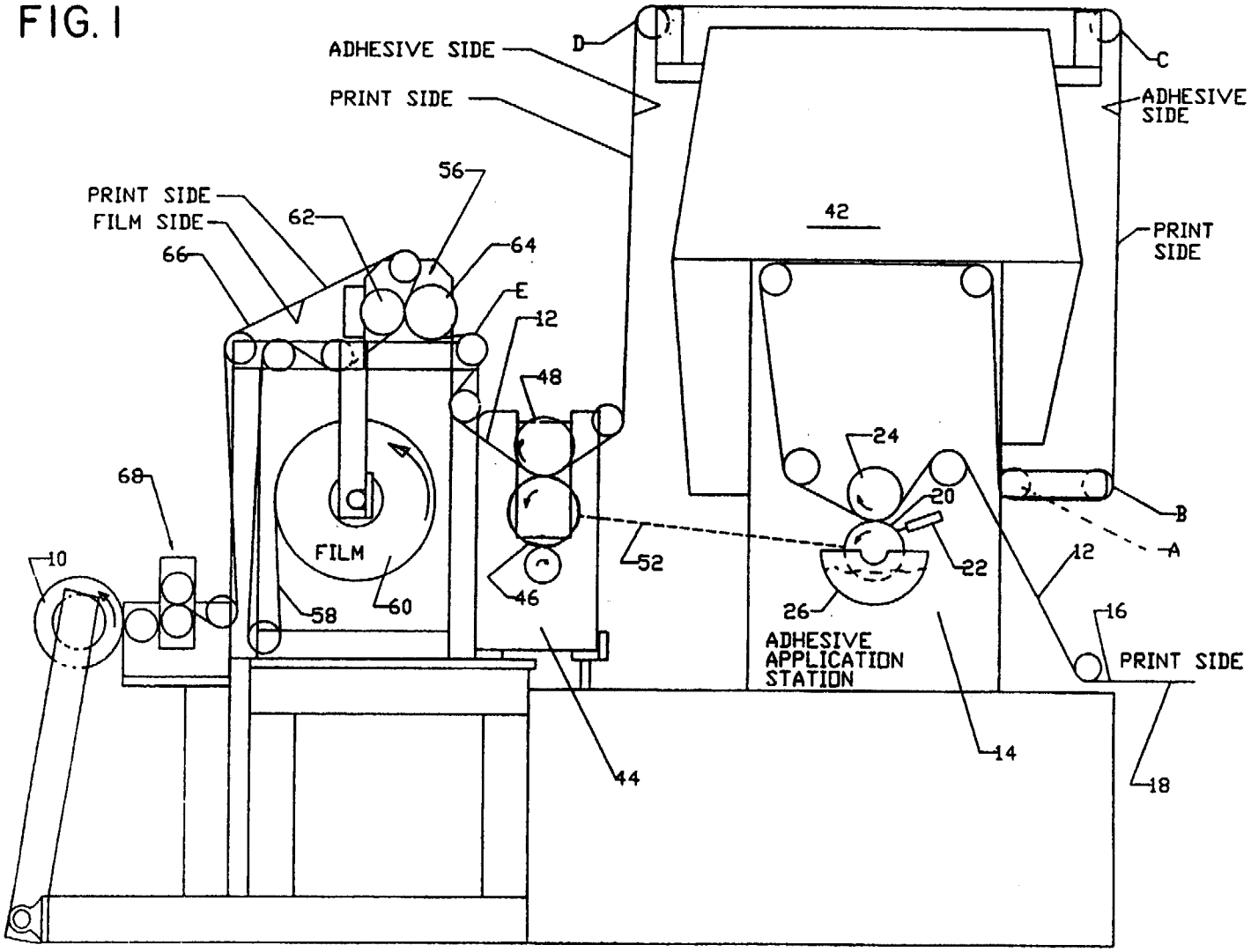
FIG. 1 is a schematic side view of an apparatus which is used for carrying out a process of this invention along with necessary supplies therefor.
Figure 3:
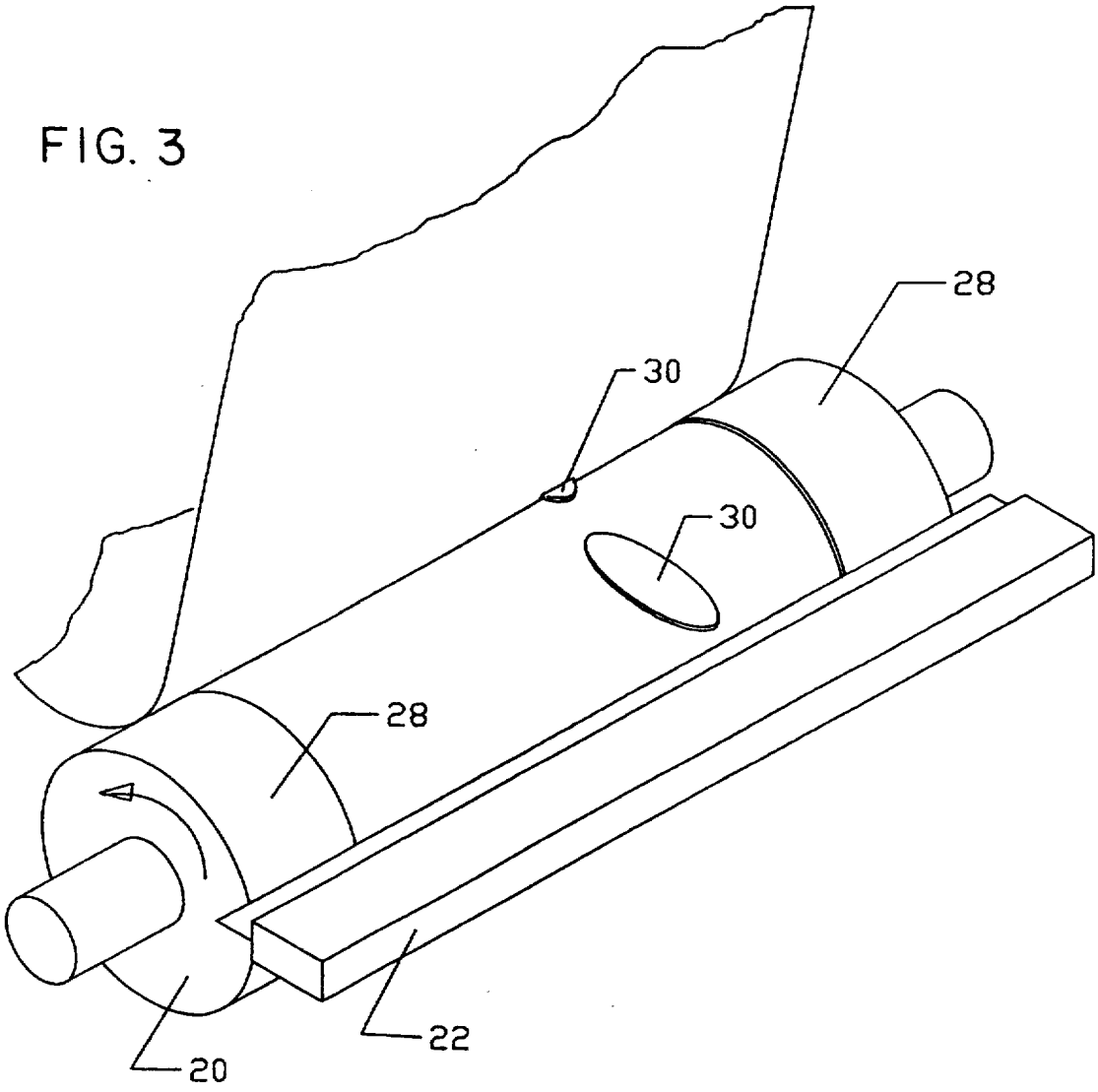
Figure 5:
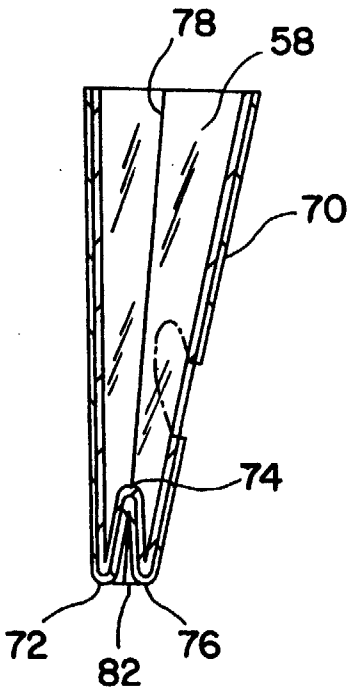
Figure 4:
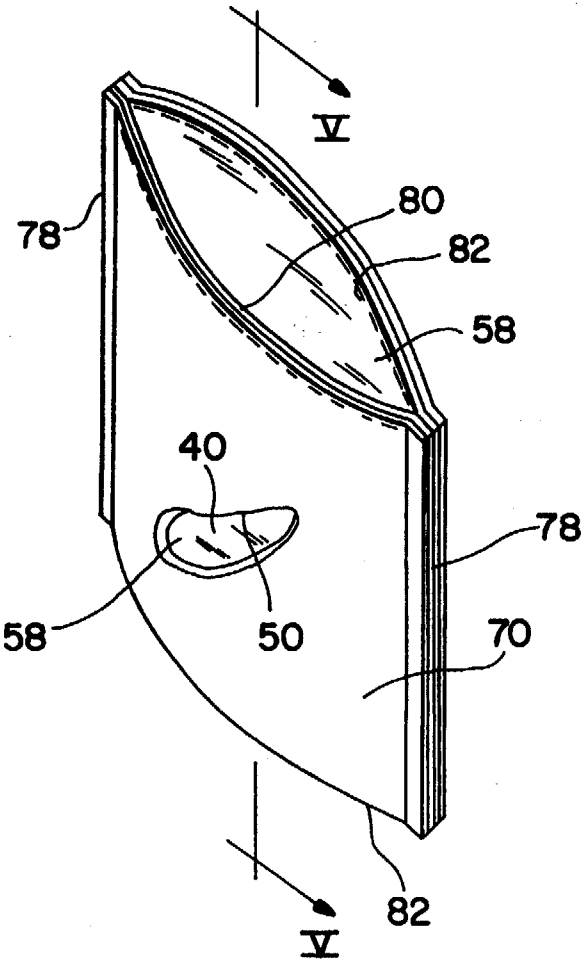

FIGS. *2a–2c* are plan views of an adhesive side of an endless strip of paper-like material used in the process carried out by the apparatus of FIG. 1 at different stages during the process;

FIG. *2d* is a plan view of an endless strip of composite material produced by the process carried out by the apparatus of FIG. 1;

FIG. 3 is a schematic, isometric, view of a gravure printing drum and blade applying a pressure-sensitive adhesive to an endless strip of paper-like material during a step in the process carried out by the apparatus of FIG. 1;

FIG. 4 is an isometric view of a partially-completed bag which is made using a composite endless form produced by the process carried out by the apparatus of FIG. 1;

FIG. 5 is a cross sectional view taking on line V—V in FIG. 4; and

Figure 6:
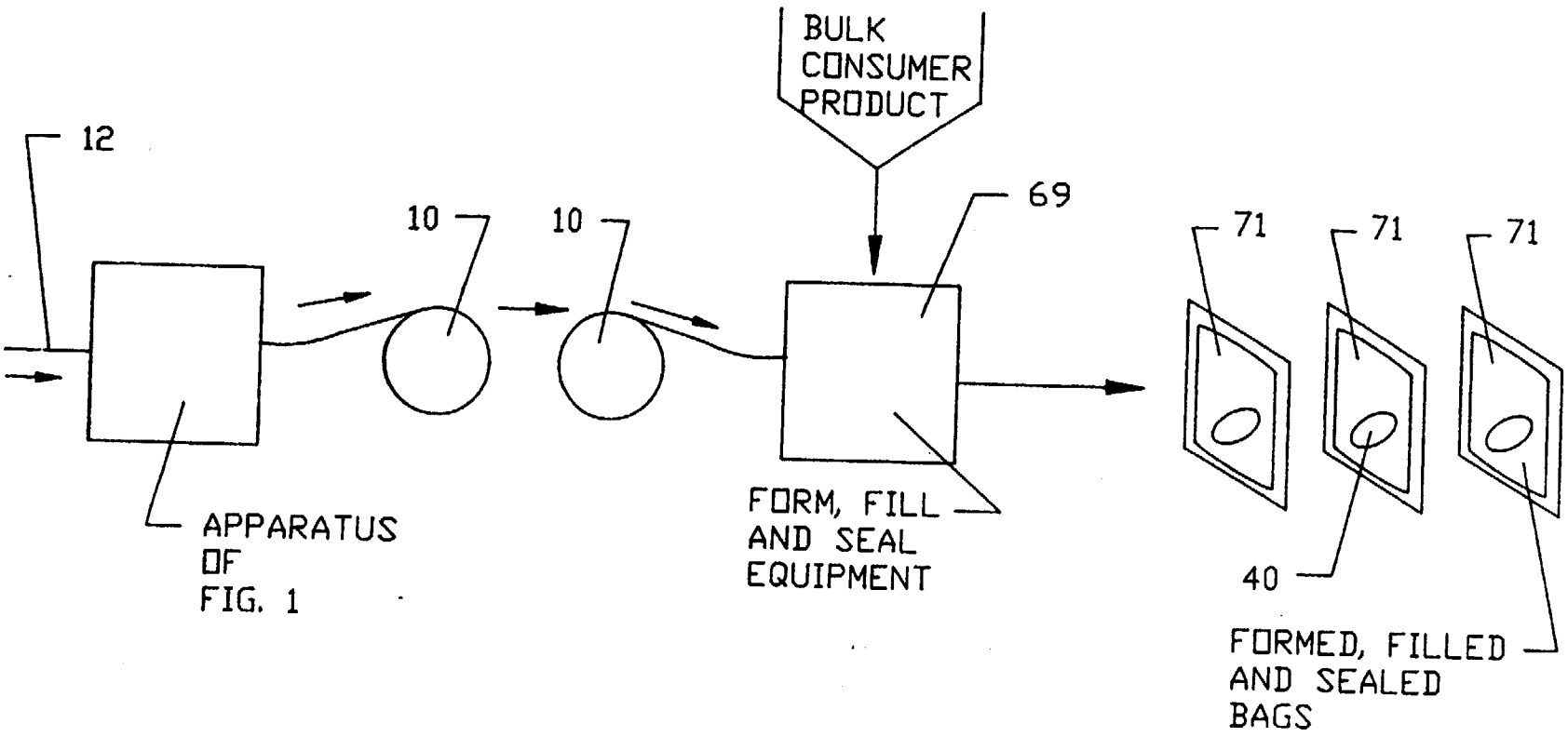

FIG. 6 is a flow chart schematically showing a sequence of converting an endless strip of paper-like material into windowed form, fill, and seal bags employing a process of this invention as part thereof.

DESCRIPTION OF PREFERRED EMBODIMENT

A process for making a composite endless form 10 for, in turn, making flexible, windowed, form, fill and seal bags containing perishable and/or nonperishable goods (this entire sequence being shown schematically in FIG. 6) includes the step of linearly conveying a flexible, substantially opaque endless strip of paper, or paper-like material, 12 through a series of printing stations, with the last of these printing stations being an adhesive application station 14 (FIG. 1) for applying a pressure-sensitive adhesive such as BOSTIK 8768A. In this respect, the endless-strip of paper-like material 12 has a print side 16 and an adhesive side 18. The print side 16 is smoother and shinier than the adhesive side 18 so as to accept sales indicia which is printed thereon. All of the printing stations include gravure printing apparatus. In this regard, only the last printing station, that is the adhesive application station 14, is shown in FIG. 1. A first printer, not shown, could, for example, apply a reverse print to the print side 16, and intermediate printers could apply multiple colors to the print side 16 including varnish. The last station would be the adhesive application station 14 which applies a pressure-sensitive adhesive to the adhesive side 18. Although only the adhesive application station 14 is shown and described, it is understood that the other printing stations (not shown) have substantially the same structure, and function substantially in the same manner. Basically, the adhesive application station 14 includes a gravure print drum 20 (see FIG. 3 for more detail), a gravure wiping blade 22, an Impression cylinder 24 (shown only in FIG. 1), and an adhesive supply 26.

The gravure print drum 20 has raised edges 28 and raised islands 30 (there are three (only two shown) in the depicted embodiment). Each raised island corresponds to a window area of a bag to be made. In this regard, gravure print drums normally contain indentations for receiving fluid printing material (e.g. ink) and raised areas which do not receive fluid printing material. The blades therefor, such as blade 22, wipe the fluid print material from the raised areas but leave the fluid print material in the indentations. Thus, in this case, the raised edges 28 and the raised islands 30 of the drum 20 are wiped clean by the gravure wiping blade 22 but otherwise the surface of the gravure print drum 20 is a continuous indentation which is filled with a pressure-sensitive adhesive 31, that is applied to the adhesive side 18 of the endless-strip of paper-like material 12 in all areas thereof except at the edge margins 32 and window areas 34.

With regard to positions of the window areas 34, the endless-strip of paper-like material 12, other then its edge margins 32 which will be slit away as a final step, comprises individual bag forms 36*a*, 36*b*, 36*c*, etc which are eventually to be divided at cutlines 38 indicated by dashed lines. There is at least one window area 34 in each bag form 36*a, b, c*, etc. It should be noted in FIGS. 2*a*–2*d*, and FIGS. 3–5 that a window 40 to be made in each form, fill and seal bag made with the endless composite form of this invention is oblong in a direction diagonal to an axis of elongation of the endless-strip of flexible paper-like material. It has been learned that by using such a configuration of a window 40 the endless-strip of paper-like material 12 remains more stable during subsequent operations to be carried out thereon.

In any event, once the endless-strip of paper-like material 12 has had adhesive applied to the adhesive side 18 thereof by the print drum 20 it is guided in the adhesive application station 14 past a curer 42 which applies heat to the adhesive on the endless-strip of paper-like material so that it is made tacky and is therefore prepared for eventual marriage to a film. The endless-strip of paper-like material exits the adhesive station and is guided by rollers A–E which have been fluoropolymer coated to prevent sticking of the tacky adhesive to the rollers.

Figure 2A:
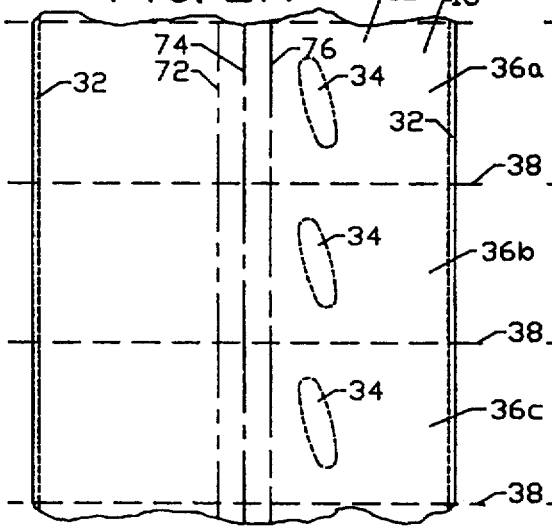
Figure 2B:
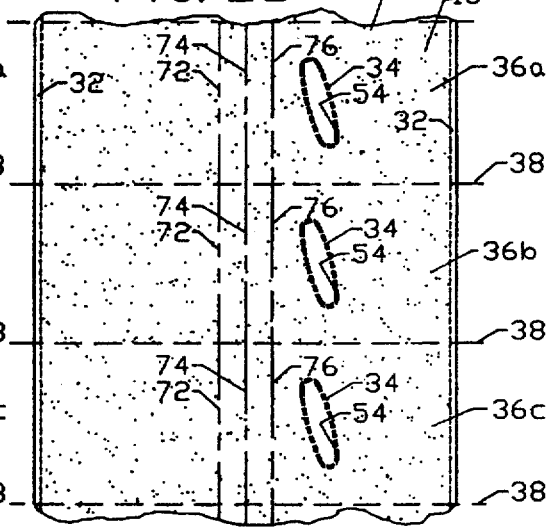
Figure 2C:
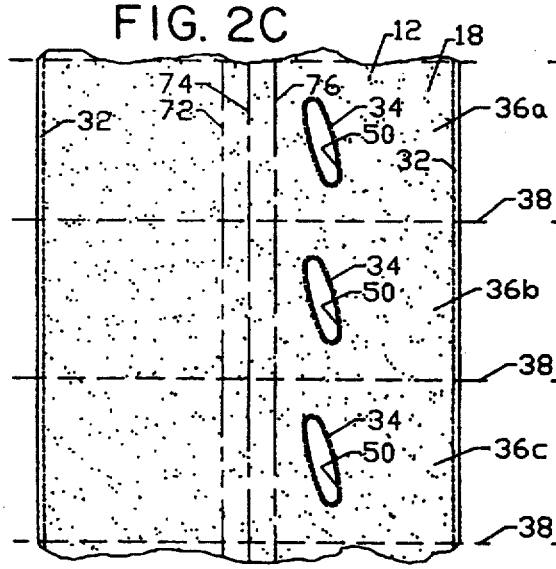
Figure 2D:
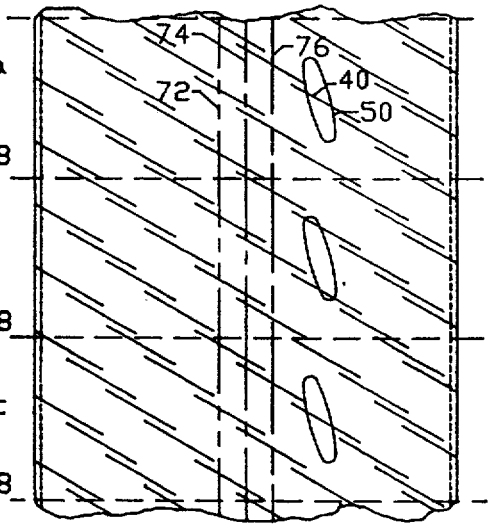

The endless-strip of paper-like material 12 is next guided through a window blanking station 44 which has a rotary, "crush-cut" or "cookie-cutting", die 46 for cooperating with a drum anvil 48 to cut window openings 50 at the window areas 34, which do not have adhesive thereat, on each of the bag forms 36*a, b, c*, etc. In this regard, rotation of the print drum 20 is synchronized with rotation of the rotary die 46 by a linkage 52 which ensures that the die 46 always cuts a window blank for making a window opening 50 at each adhesive-less window area 34. This is shown in FIGS. 2*b* and 2*c* where a window blank 54 is delineated by dashed lines in FIG. 2*b* and the window opening 50 is shown in a solid line in FIG. 2*c*, both within the adhesive-less window area 34.

The endless-strip of paper-like material 12 is next fed to a laminating station 56 where it is pressed together with an oriented polyethylene or polypropylene, transparent heat-sealable film 58 supplied from a film roll 60. In this regard, the endless sheet of heat-sealable film 58 is at least as wide as the endless-strip of paper-like material 12 with the exception of the edge margins 32 of the paper-like material 12 which will be later cut away. The adhesive side 18 of the endless-strip of the paper-like material 12 and the endless heat-sealable film 58 are pressed together between two rolls 62 and 64 which are biased toward one another. The heat-sealable film 58 is purchased to be corona treated on a side thereof coming into contact with the pressure-sensitive adhesive. Thus, when the corona treated side of the heat-sealable film 58 is pressed firmly against the adhesive on the adhesive side 18 of the endless-strip of paper-like material 12, it adheres tightly thereto so as to form a raw composite endless form 66. It should be understood that the heat-sealable film 58 is centered on the endless-strip of paper-like material 12 so as to cover substantially all of the adhesive on the adhesive side 18, although not necessarily the edge margins 32 which will be cut away.

The raw composite endless form 66, which still has the edge margins 32 thereon, is then run through a slitter station 68 which removes these edge margins 32 to form the composite endless form 10 of individual bag forms attached side-to-side.

The composite endless form 10 can be directly used by form, fill and seal equipment 69 for forming bags 70 (FIGS. 4 and 5), filling these bags with product, and finally sealing the bags 71. In this regard, the form, fill and seal equipment can operate in the very same way with the composite endless form 10 as it operates with endless forms of the prior art. That is, it cuts the individual bag forms 36*a, b, c*, etc. apart along cutlines 38, folds the individual bag forms along foldlines 72, 74 and 76, heat seals the heat-seal surfaces of the heat-sealable film 58 together at side edges 78, fills the pouch thereby formed with product, and finally seals the heat-sealable sides of the heat-sealable film 58 together at top edges 80 of the individual bag-forms to thereby enclose the product in individual bags 71, each having a window 40.

While the invention has been particularly shown and described with reference to a preferred embodiment, it will be understood by those skilled in the art that various changes in form and detail may be made therein without departing the spirit and scope of the invention. For example, the slitter station 68, as well as the other stations, must not be mounted on a single frame. Thus, for example, the slitting step could be carried out at a different time as are the other operations.

It will be appreciated by those of ordinary skill in the art that the process of this invention results in a composite endless form which, in turn, can be used for making flexible windowed form, fill and seal bags containing perishable and/or nonperishable goods. In this regard, such bags are often made on "Bartelt" and other form, fill and seal equipment which applies heat at approximately 325° F. for heat-sealing edges of bags. Composite endless forms made by this process can be sealed at these temperatures. Similarly, the composite endless form made with the process of this invention has appropriate "dead-fold" characteristics as to be used by form, fill and seal machines. A bag thusly formed by a form, fill and seal machine can have a gusset 82 (FIG. 5) which allows the bag to stand on a retail shelf by itself.

By applying an adhesive with a printer, a desired adhesive configuration is obtained which allows one to later cut window blanks from the endless-strip paper-like material without adversely affecting downstream machinery. Similarly, by synchronizing the adhesive application station 14 and the window blanking station 44 it is assured that window openings are always made in the window areas, where there is no adhesive.

By cutting the window openings 50 at a diagonal relative to an axis of elongation of the endless-strip of paper-like material a stability of the web can be predicted with some certainty. In this respect, a diagonal window opening does not affect the shape of the endless-strip of paper-like material 12 when a traction force is applied thereto as much as if a window of the same size extended transverse to or parallel to, the axis of elongation. Similarly, such a diagonal window is more pleasing aesthetically than would be a long vertical or horizontal window.

By laminating the endless-strip of paper-like material with the previously prepared heat-sealable film it is possible to create relatively easily a window in a composite form which can be used in form, fill and seal machines.

The embodiments of the invention in which an exclusive property or privilege are claimed are defined as follows:

1. A process for making a composite endless form for, in turn, making flexible windowed, form, fill and seal bags containing perishable and/or nonperishable goods, said process comprising the steps of:

linearly conveying an endless strip of flexible, substantially opaque, paper-like material having a print side for receiving printed indicia and an adhesive side for receiving adhesive, said endless strip of flexible paper-like material comprising individual bag-forms attached side-to-side, each having a window area and each to be used for making a windowed bag;

applying at an adhesive-application station an adhesive to substantially said entire adhesive side, with an exception of the window area of each of said individual bag forms to which adhesive is not applied;

cutting at a synchronized window-cutting station having a cutter whose operation is synchronized to positions of the window areas a window blank at each window area so as to form a window opening therein;

laminating an endless strip of transparent heat-sealable film to said adhesive side of said endless strip of flexible paper-like material with said adhesive to thereby form said composite endless form for being cut into said individual bag forms having edges and heat sealed at the edges for making individual, windowed, form, fill and seal bags.

2. A process as in claim 1 wherein said adhesive application station applies adhesive using a rotary printer.

3. A process as in claim 2 wherein said adhesive application station is one of a plurality of gravure printer stations and wherein is included the step of printing on the opposite print side of said endless-strip of paper-like material.

4. A process as in claim 3 wherein said heat-sealable film is one of oriented polypropylene and polyethylene.

5. A process as in claim 4 wherein said heat-sealable film is treated to be heat sealable on one side only.

6. A process as in claim 5 wherein said window opening is oblong and extends diagonal to an axis of elongation of said endless-strip of paper-like material.

7. A process as in claim 4 wherein said window opening is oblong and extends diagonal to an axis of elongation of said endless-strip of paper-like material.

8. A process as in claim 1 wherein said adhesive applied is a pressure-sensitive adhesive.

9. A process as in claim 1 wherein said window opening is oblong and extends diagonal to an axis of elongation of said endless-strip of paper-like material.

10. A method of making windowed bags comprising the steps of:

linearly conveying an endless strip of flexible, substantially opaque, paper-like material having a print side for receiving printed indicia and an adhesive side for receiving adhesive, said endless strip of flexible paper-like material comprising individual bag-forms attached side-to-side, each having a window area and each to be used for making a windowed bag;

applying at an adhesive-application station an adhesive to substantially said entire adhesive side, with an exception of the window area of each of said individual bag forms to which adhesive is not applied;

cutting at a synchronized window-cutting station having a cutter whose operation is synchronized to positions of the window areas a window blank at each window area so as to form a window opening therein;

laminating an endless strip of transparent heat-sealable film to said adhesive side of said endless strip of flexible paper-like material with said adhesive to thereby form said composite endless form for being cut into said individual bag forms having edges and heat sealed at the edges thereof for making individual, windowed, form, fill and seal bags;

cutting said composite endless form into said individual bag forms having edges;

folding said individual bag forms so that said heat-sealable film is in contact at edges of said individual bag forms; and filling pouches formed by said individual bag forms; and applying heat to said edges to seal said edges and thereby said material in said pouches.

11. Method as claim 10 wherein said window opening is oblong and extends diagonal to an axis of elongation of said endless-strip of paper-like material.

12. A process as in claim 1 wherein said adhesive application station is located upstream of said cutter so that said adhesive is applied before said window blank is cut.

13. A process as in claim 10 wherein said adhesive application station is located upstream of said cutter so that said adhesive is applied before said window blank is cut.

* * * * *